US005461554A

United States Patent [19]

Leonetti et al.

[11] Patent Number: 5,461,554

[45] Date of Patent: Oct. 24, 1995

[54] DOUBLE ENDED HIGH INTENSITY LAMP HOLDER

[75] Inventors: Frank M. Leonetti; Luis E. Hernandez, both of Los Angeles, Calif.

[73] Assignee: Leonetti Company, Hollywood, Calif.

[21] Appl. No.: 258,247

[22] Filed: Jun. 10, 1994

[51] Int. Cl.[6] ..... F21V 15/04; F21V 19/02

[52] U.S. Cl. ..... 362/390; 362/284; 362/285; 362/294; 362/372; 248/604

[58] Field of Search ..... 362/263, 257, 362/261, 264, 285, 294, 372, 382, 390; 248/603, 604, 614

[56] References Cited

U.S. PATENT DOCUMENTS

| | | | |
|---|---|---|---|
| 241,112 | 5/1881 | Woolley et al. | 248/604 |
| 3,636,341 | 1/1972 | Miller | 362/263 |
| 3,833,802 | 9/1974 | Fridrich | 362/263 |
| 3,940,606 | 2/1976 | Lemons | 362/263 |
| 4,378,583 | 3/1983 | Caprari | 362/263 |
| 4,870,552 | 9/1989 | Vitta et al. | 362/390 |
| 4,939,629 | 7/1990 | Glanton et al. | 362/263 |
| 5,067,065 | 11/1991 | Dahlgren | 362/390 |
| 5,073,846 | 12/1991 | Lin | 362/263 |
| 5,128,851 | 7/1992 | Kasmatka et al. | 362/306 |
| 5,228,770 | 7/1993 | Brunson | 362/390 |

FOREIGN PATENT DOCUMENTS

| | | | |
|---|---|---|---|
| 460062 | 9/1913 | France | 362/390 |
| 260467 | 6/1913 | Germany | 362/390 |
| 19857 | of 1914 | United Kingdom | 362/390 |

*Primary Examiner*—Ira S. Lazarus
*Assistant Examiner*—Leonard E. Heyman
*Attorney, Agent, or Firm*—Kelly Bauersfeld & Lowry

[57] ABSTRACT

A double ended high intensity lamp holder of the type used in television and motion picture lighting applications is provided with an improved lamp holder for securely and safely supporting a double ended lamp. The improved fixture includes a pair of lamp holder assemblies each including a generally U-shaped lamp holder member with a spring clip thereon for quick and easy snap-fit reception of the opposite ends of a double ended lamp. The two lamp holder members are resiliently suspended by a spring mounting arrangement from a corresponding pair of support brackets, whereby the double ended lamp is resiliently mounted in a manner substantially isolating and protecting the lamp against damage due to thermal stress, physical shock, vibration, etc.

18 Claims, 4 Drawing Sheets

DOUBLE ENDED HIGH INTENSITY LAMP HOLDER

BACKGROUND OF THE INVENTION

This invention relates generally to improvements in high intensity lighting equipment of the type used in television, motion picture and theatrical lighting applications for illuminating stage and studio sets, on-location scenes and the like. More specifically, this invention relates to an improved high intensity lamp holder of the type having a double ended lamp, wherein the improved lamp holder resiliently supports the lamp to prevent damage due to thermal stress, physical shock, vibration, and the like.

High intensity fixtures are generally known in the art for use in general lighting purposes in television, motion picture, and theatrical productions. Example of such high intensity lamps include gas vapor, arc, metal halide (HMI), or equivalent type, all of which commonly include a metal lamp housing having an appropriate high intensity lamp mounted therein. Such high intensity lamps are available in a variety of different sizes and power ratings, for example, on the order of 500 watts to 18 or more kilowatts. Such high intensity lamps are known to generate substantial quantities of heat energy during normal operation, with lamp surfaces typically exhibiting a temperature during normal operation on the order of about 600° to 800° C. (1100° to 1500° F.). These lamps produce large quantities of light, are relatively costly, and in one common form, are provided in a double ended geometry for connection of opposite ends to an appropriate electrical power supply.

In the past, double ended high intensity lamps have included an aligned pair of lamp holders having large and heavy ridged heat sinks, with limited tolerances that apply stress to the lamp, resist thermal expansion, restrict convection cooling, and do not isolate the lamp from physical shock. Such lamp holders were adapted for receiving and supporting a double ended lamp in a predetermined position within a lamp housing. The dual lamp holders are normally designed to securely position the lamp filament in front of a curved reflector, so that substantially all of the generated light will be projected forwardly from the lamp housing. However, during normal use, generated heat subjects the lamp structure to significant thermal stress which can contribute to premature bulb failure. Efforts to conduct heat through terminal convection from the lamp, and thereby reduce thermal stress, have involved relatively sophisticated heat sink structures incorporated into the lamp holders. Unfortunately, these heat sink structures increase the cost of the high intensity fixture and additionally require at least some disassembly to permit installation or removal of the double ended lamp.

Moreover, the dual sockets in prior double ended high intensity fixtures have not satisfactorily protected the fragile lamp against damage due to physical shock and/or vibration, particularly of the type encountered during transport to and from a filming site and/or in the course of moving the fixture to different positions on the set. To protect the fragile double ended lamp, it has been necessary to remove the lamp from the fixture prior to movement or transport, and to reinstalled the lamp when the fixture is positioned for use. Such lamp removal and reinstallation is undesirably time-consuming, and also involves substantial risk of damage attributable to manual mishandling.

The present invention provides an improved double ended high intensity fixture having an lamp holder for receiving and supporting the opposite ends of a double ended lamp, wherein the lamp is resiliently supported in a floating manner accommodating thermal stress and substantially isolating the lamp from shock and vibration.

SUMMARY OF THE INVENTION

In accordance with the invention, a double ended high intensity fixture is provided of the type used in television and motion picture and theatrical lighting applications and the like. The improved fixture includes an improved double ended lamp holder for resiliently receiving and supporting a double ended high intensity lamp selected from a range of lamp sizes and power ratings. The fixture includes a pair of lamp holder assemblies having resiliently suspended, generally U-shaped lamp holder members equipped with spring clips to permit rapid and easy snap-fit lamp installation. The suspended lamp holder members permit three dimensional displacement of the supported opposite ends of the high intensity lamp, whereby the lamp holder members substantially isolate the fragile lamp from thermal stress, shock loads, vibrations, etc.

In the preferred form, the improved double ended lamp holder is mounted within a fixture housing in a position for receiving and supporting the double ended lamp with its light source filament or burner disposed in front of and generally in alignment with a curved-surface rear reflector. The entire fixture may be adapted for fore-aft adjustment relative to the reflector. The fixture comprises a frame for supporting the pair of bracket assemblies, each including a corresponding one of the U-shaped socket members, wherein the two lamp holder assemblies may be mounted for lateral positional adjustment toward and away from each other.

Each lamp holder assembly includes an insulator mounted on the fixture frame and carrying a terminal block including for electrically connecting the lamp to an appropriate power supply, while electrically insulating the bulb from the fixture frame and other components of the lamp housing. A generally U-shaped support bracket is mounted on the terminal block in an upwardly open orientation. A plurality of tension springs, preferably at least three tension springs, are provided to resiliently support the associated U-shaped lamp holder in an upwardly open orientation within the support bracket. In the preferred form, a heat shield is mounted at the inboard side of each socket assembly to shield the terminal block and support bracket from heat and ultraviolet radiation generated by the high intensity lamp during use.

The double ended lamp is installed quickly and easily by pressing and snap-fitting the opposite ends thereof into the lamp holder members of the two bracket assemblies. The opposite ends of the bulb can then be connected quickly and easily, via the terminal blocks, to the appropriate electrical power supply. If desired, the lamp holder assemblies can be laterally adjusted to ensure substantially centered alignment of the light source filament with the rear reflector and to accommodate various lamp of different sizes provided by different manufactures. In use, the spring-suspended lamp holder members can undergo three dimensional displacement to compensate for thermal-induced lamp dimensional changes. In addition, the lamp holder members resiliently support the lamp in a manner which substantially protects the lamp against damage attributable to physical shock or vibration. The double ended lamp may thus be installed into the fixture housing, and the fixture may be transported or otherwise moved about as needed without significant concern for bulb damage.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
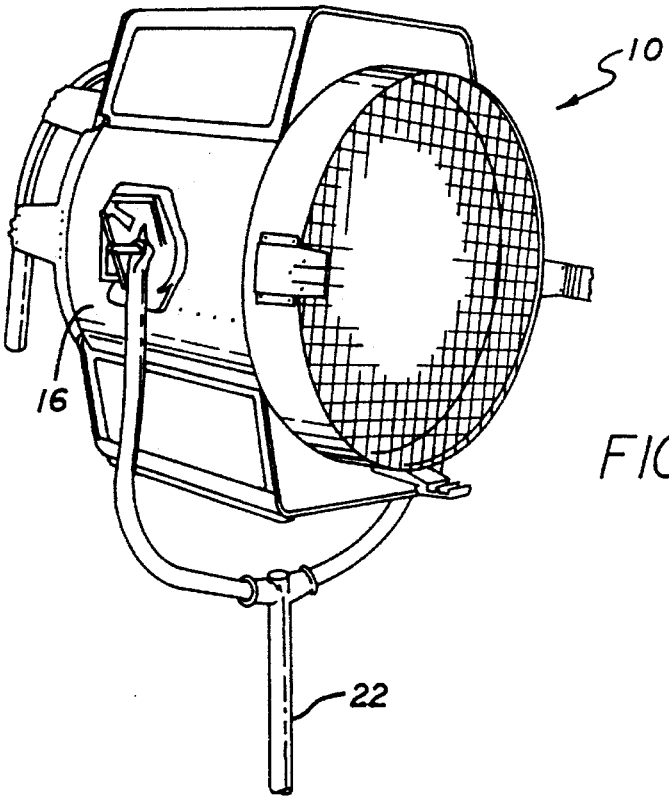
FIG. 1 is a perspective view illustrating an improved HMI fixture embodying the novel features of the invention, and shown supported on a conventional fixture stand.

As shown in the exemplary drawings, an improved high intensity fixture referred to generally in FIG. 1 by the reference numeral 10 is provided for use in television, motion picture, theatrical and other lighting applications. The high intensity fixture 10 is designed for use with a double ended lamp 12 (FIGS. 2–4) which is quickly and easily installed into and safely supported within an improved double ended lamp holder 14. The improved lamp holder 14 supports the lamp 12 in a resilient manner, thereby protecting the lamp against damage attributable to thermal stress, shock loads, vibrations, etc.

The improved high intensity fixture of the present invention is normally used to provide a spotlight or for general lighting purposes in a studio or on-location set in the entertainment industry. In this regard, the high intensity lamp 12 typically comprises a gas vapor arc lamp such as a so-called HMI globe commonly used in such lighting applications. High intensity lamps of this general type are available in a range of sizes and different power ratings, all of which are relatively costly and generate relatively large quantities of heat during normal operation. The improved double ended lamp holder 14 of the present invention is advantageously designed to receive and support a double ended lamp 12 selected from a range of different sizes and power rating, without requiring any significant lamp holder adjustment.

Figure 2:
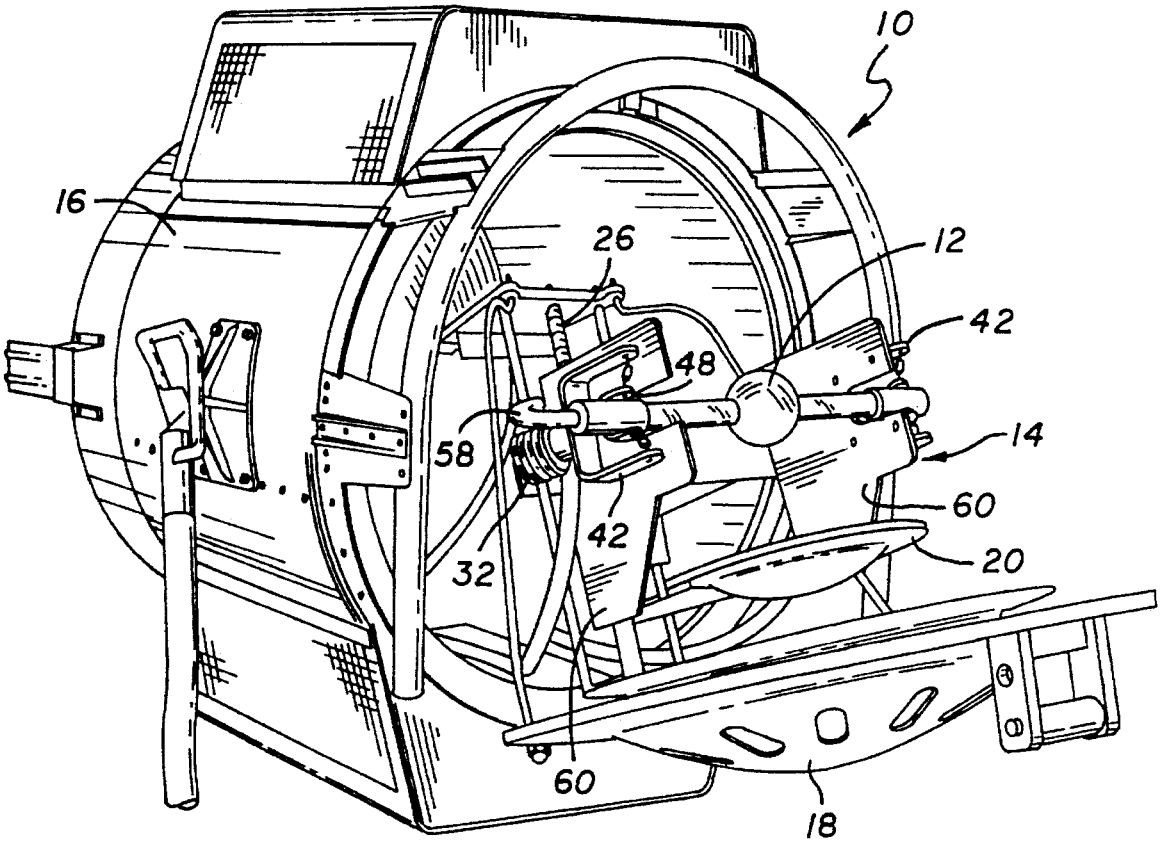
FIG. 2 is an enlarged rear perspective view of the high intensity lamp holder, and showing a rear door in an open position to permit installation of a double ended high intensity lamp.

As shown generally in FIGS. 1 and 2, the HMI fixture 10 comprises a fixture housing 16 of generally cylindrical overall shape to receive and support the high intensity lamp 12 which is adapted to produce a high intensity beam of light for discharge from a forward open end of the housing. The lamp holder 14 is mounted onto a housing rear door 18 (FIG. 2) to orient the lamp 12 in front of a curved-surface reflector 20 which assists in projecting generated light in a forward direction. The rear door 18 is normally mounted onto the housing in a hinged manner (not shown) to permit movement of the rear door to an open position as viewed in FIG. 2, for purposes of accessing the lamp holder 14 for lamp installation and/or removal. A conventional fixture stand 22 (FIG. 1) or the like supports the fixture housing 16 for convenient use.

Figure 3:
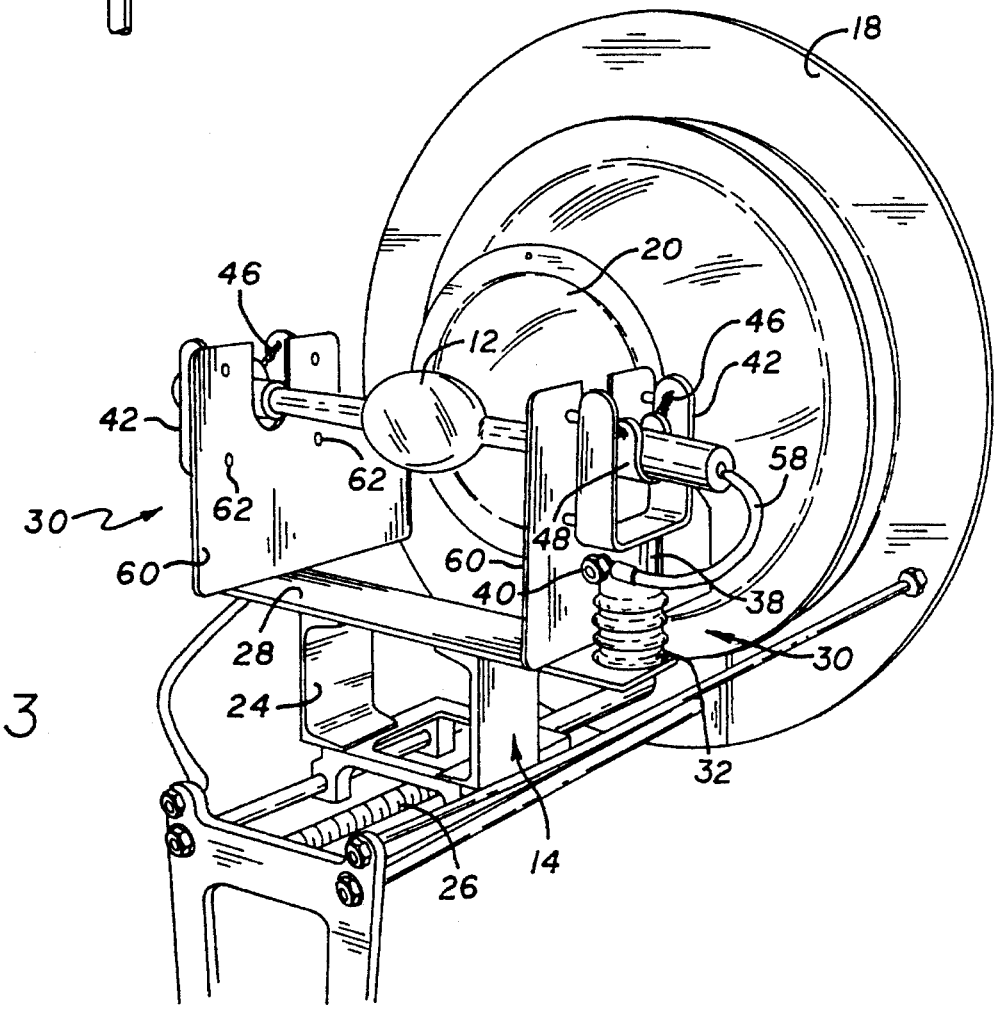
FIG. 3 is an enlarged fragmented perspective view of a portion of the fixture, illustrating the improved double ended lamp holder for supporting a double ended lamp.
Figure 4:
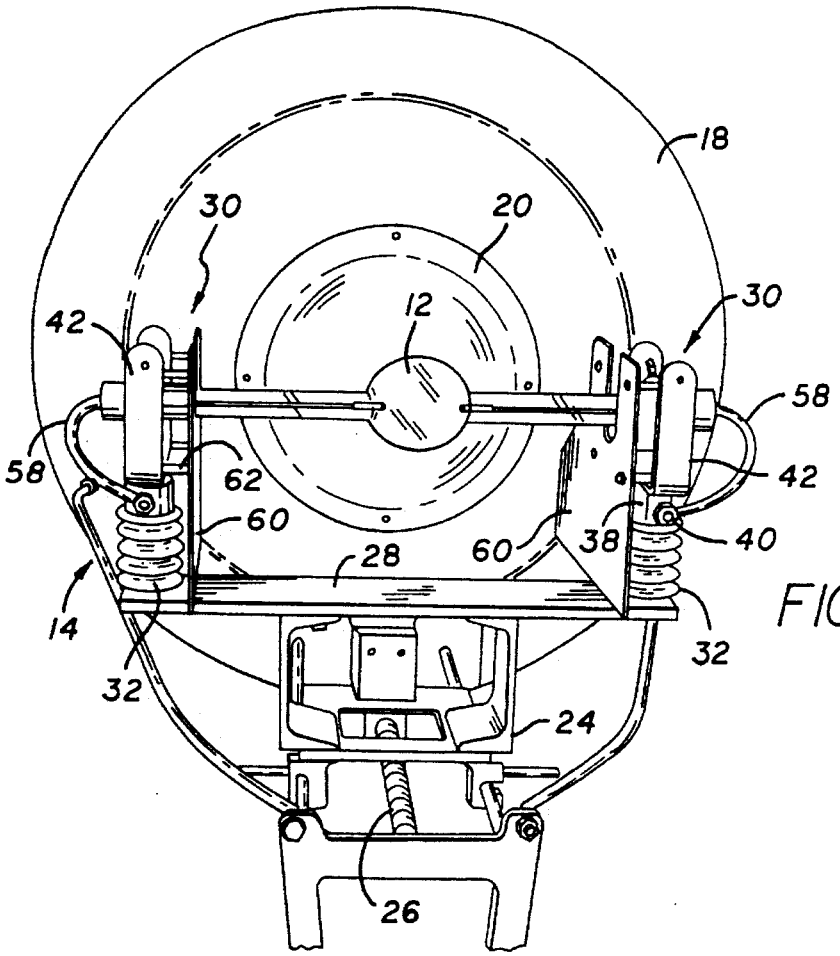
FIG. 4 is a front perspective view showing the improved lamp holder and bracket of the present invention.

As shown in FIGS. 2–4, the lamp holder 14 comprises a frame 24 which can be mounted on a lead screw 26 adapted for positional fixture adjustment in a fore-aft direction in front of the reflector 20. In general terms, the lamp holder frame 24 includes a laterally extending base plate 28 which in turn carries a pair of lamp holder assemblies 30 (FIG. 5) at opposite ends thereof. The lamp holder assemblies 30 project upwardly from the base plate 28, at opposite side of the reflector 20, to receive and support the double ended lamp 12 in a position with a central globe portion having a light source filament therein disposed in general vertical alignment with a centerline of the reflector 20.

Figure 5:
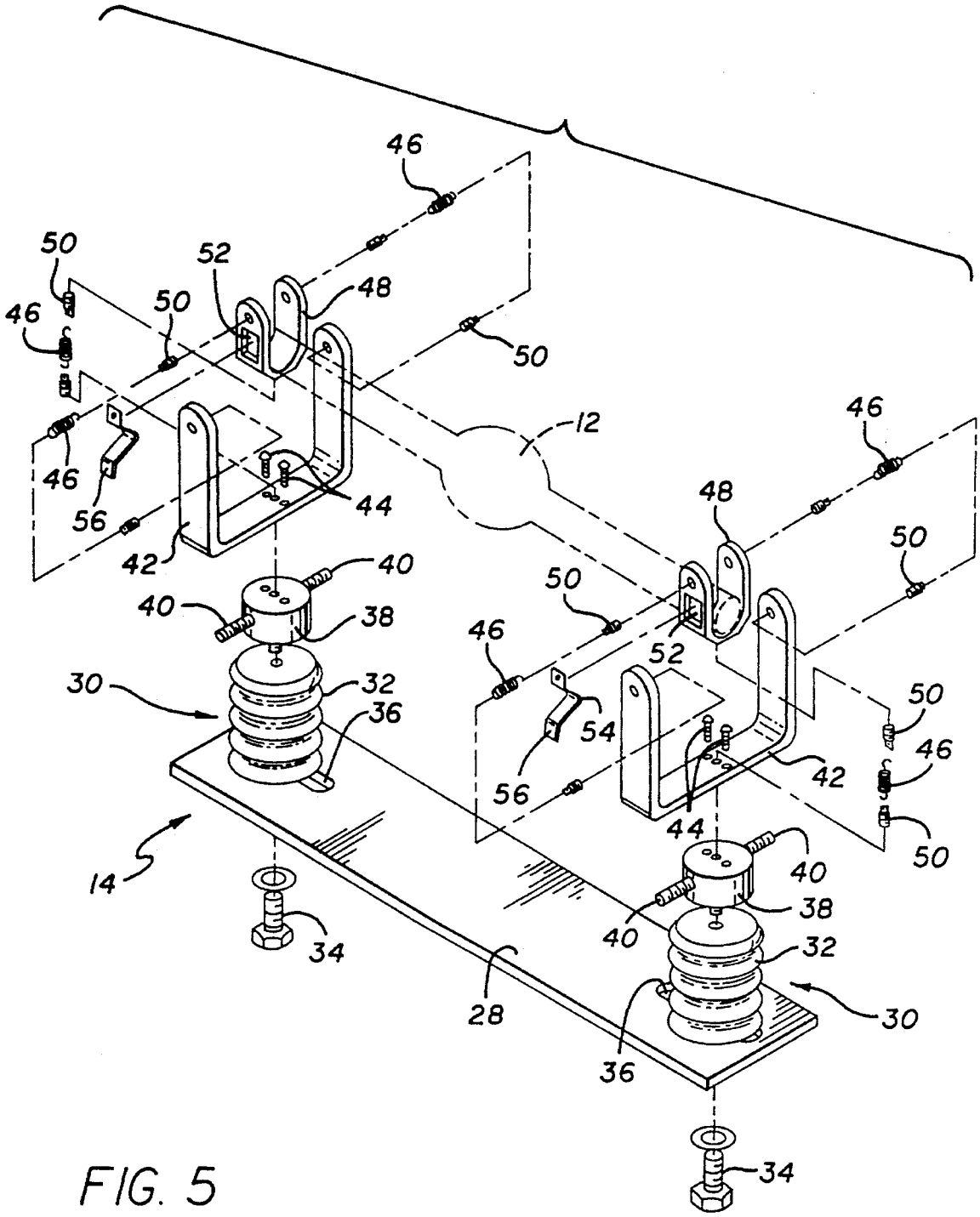
FIG. 5 is an exploded perspective view illustrating assembly of the various components of the improved double ended lamp holder and bracket.

As shown best in FIG. 5, each lamp holder assembly 30 comprises an insulator 32 fastened onto the base plate 28 as by means of a bolt 34 which extends upwardly through a laterally elongated slot 36 in the base plate. The slots 36 thus permit lateral or transverse positional adjustment of the corresponding lamp holder assemblies 30, for purposes of laterally aligning the lamp light source with the reflector 20 as will be described in more detail.

A terminal block 38 is fastened onto the top of the insulator 32 of each lamp holder assembly 30. The terminal block 38 includes at least one and preferably dual conductive studs 40 for use in electrically connecting the lamp 12 to a suitable power source (not shown).

Figure 7:
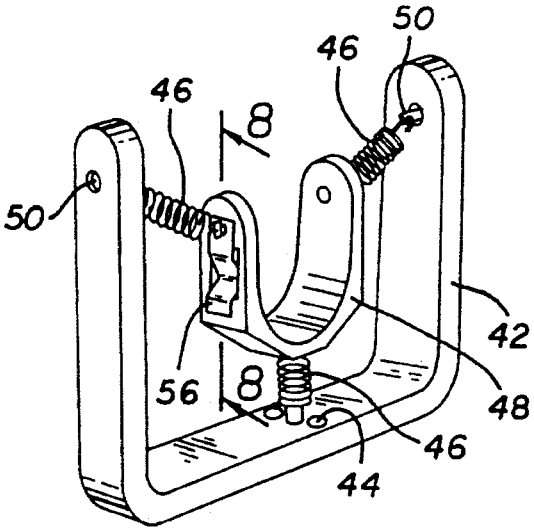
FIG. 7 is an enlarged perspective view depicting construction details of an improved lamp holder and bracket assembly forming a portion of the fixture.
Figure 8:
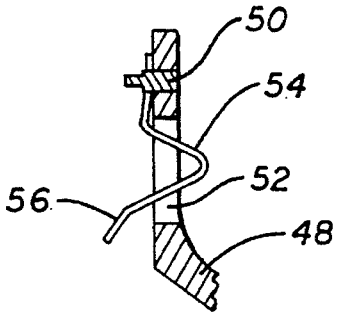
FIG. 8 is an enlarged fragmented sectional view taken generally on the line 8—8 of FIG. 7.
Figure 6:
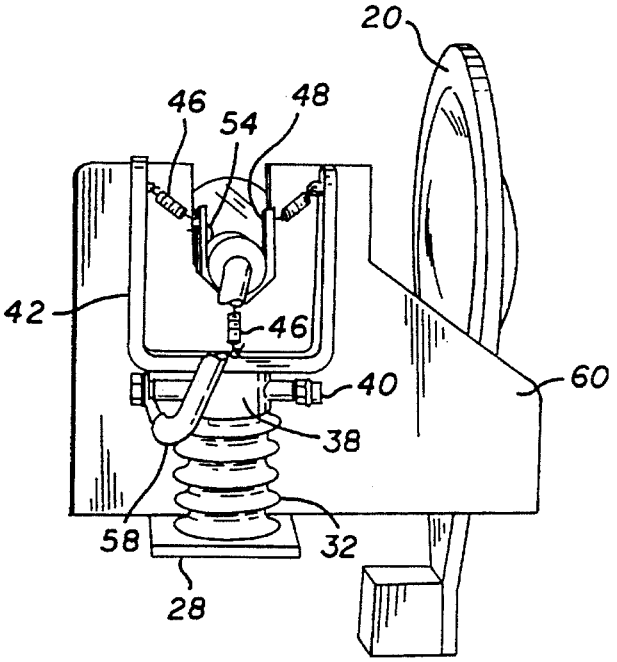
FIG. 6 is a side elevation view of the improved lamp holder and bracket shown in FIGS. 3 and 4.

A pair of generally U-shaped support brackets 42 are mounted in turn onto the terminal blocks 38 of the two lamp holder assemblies 30, as by means of a pair of connector screws 44. The support bracket 42 is positioned in an upwardly open orientation defining a transverse opening extending along an axis generally parallel to the longitudinal axis of the underlying base plate 28. A plurality of tension springs 46 are connected between the support bracket 42 and a generally U-shaped lamp holder member 48, as by means of set screws 50, for resiliently supporting the lamp holder member 48 in an upwardly open orientation within the support bracket 42. As shown in FIGS. 6 and 7 in the preferred form, at least three of the tension springs 46 are provided in a spaced three-point support array to resiliently support the lamp holder member 48 in a manner permitting three dimensional floating movement of the lamp holder member.

One leg of the U-shaped lamp holder member 48 defines an opening 52 through which the toe 54 of a spring clip 56 protrudes into the interior volume of the lamp holder member. In this regard, one end of the spring clip 56 is conveniently attached to an outboard side of the lamp holder member leg by an associated one of the set screws 50 used to connect the tension springs 46. The spring clip 56 yieldably accommodates seated reception of one end of the double ended lamp 12 with a light snap-fit force, and functions to retain the lamp end securely seated within the lamp holder member.

In this regard, the double ended lamp 12 has a conventional geometry to include the generally spherical central globe with opposite ends of generally cylindrical shape protruding outwardly from the lamp for seated reception into the lamp holder members 48. Conductor cables 58 at opposite ends of the lamp 12 are quickly and easily connected to the conductive studs 40 on the associated terminal block 38, which in turn provide means for connecting the lamp to the power source (not shown).

Accordingly, when the rear door 18 of the fixture housing 16 is opened as viewed in FIG. 2, the lamp holder assemblies 30 of the improved lamp holder 14 are easily accessed for snap-in mounting of a double ended lamp 12 of selected size and power rating. The door 18 can then be closed and latched for normal fixture operation. During such operation, the lamp holder members 48 resiliently support the fragile lamp 12 particularly with regard to lateral freedom of motion to compensate for thermal dimensional variations which occur in response to generated heat. Thus, the socket members 48 movably relieve dimensional variations caused by thermal factors, and thereby substantially isolate the fragile lamp 12 from thermal stress and potential premature failure attributable thereto.

Moreover, the lamp holder members 48 resiliently support the lamp 12 for displacement in three dimensions whereby shock loads and vibration loads are not rigidly transmitted to the fragile lamp structure. Instead, the lamp holder members 48 accommodate and absorb such mechanical loads to protect the lamp against mechanical damage. With the present invention, the HMI fixture 10 can be transported to a filming set and moved about at will on the set, with the lamp 12 installed at all times. The resilient mounting arrangement protects the lamp against mechanical shock and vibration damage, such that it is unnecessary to remove the lamp from the fixture housing during transport.

In accordance with an additional aspect of the invention, simplified heat shields are provided to protect the lamp holder assemblies 30 against heat-caused damage and/or radiation damage during lamp use. In this regard, as shown in FIG. 3, a thin heat shield plate 60 is mounted by screws 62 or the like to the inboard side of the support bracket 42 on each lamp holder assembly. These heat shields 60 substantially block radiated light and accompanying heat energy and ultraviolet radiation from contacting the lamp holder assemblies 30. A preferred heat shield material comprises mica sheet available from Cogebi, Inc., of Dover, N.H., under the trade name Cogetherm 505P. With this structure, the opposite ends of the double ended lamp 12 are left substantially exposed to convective air flow passing through the fixture housing 16 to result in improved convective and conductive cooling of the lamp.

A variety of further modifications and improvements to the present invention will be apparent to persons skilled in the art. Accordingly, no limitation on the invention is intended by way of the foregoing description and accompanying drawings, except as set forth in the appended claims.

What is claimed is:

1. A double ended high intensity lamp holder for receiving and supporting a double ended lamp, comprising:

a double ended lamp holder a frame, a pair of lamp holder members each including a spring clip for respectively snap-fit receiving and supporting opposite ends of the lamp, and means for resiliently mounting said lamp holder members on said frame whereby said lamp holder members movably accommodate thermal and mechanical stress during lamp use.

2. The double ended high intensity lamp holder of claim 1 wherein said means for resiliently mounting said lamp holder members comprises a plurality of springs.

3. The double ended high intensity lamp holder of claim 1 wherein said means for resiliently mounting said lamp holder members comprises a pair of support brackets mounted on said frame, and spring means for resiliently suspending said lamp holder member respectively from said support brackets.

4. The double ended high intensity lamp holder of claim 3 further including means for adjustably positioning said support brackets on said frame.

5. The double ended high intensity lamp holder of claim 1 further including a curved-surface reflector mounted at one side of said holder, said lamp holder members being for supporting the lamp in a predetermined position relative to said reflector.

6. A double ended high intensity lamp holder for receiving and supporting a double ended lamp, comprising:

a double ended lamp holder a frame, a pair of lamp holder members for respectively receiving and supporting opposite ends of the lamp, and means for resiliently mounting said lamp holder members on said frame whereby said lamp holder members movably accommodate thermal and mechanical stress during lamp use; and further including a pair of insulators mounted on said frame, and a pair of support brackets mounted respectively on said insulators, said means for resiliently mounting said lamp holder members comprising spring means for resiliently suspending said lamp holder members respectively from said support brackets.

7. A double ended high intensity lamp holder for receiving and supporting a double ended lamp, comprising:

a double ended lamp holder a frame, a pair of lamp holder members for respectively receiving and supporting opposite ends of the lamp, and means for resiliently mounting said lamp holder members on said frame whereby said lamp holder members movably accommodate thermal and mechanical stress during lamp use; and further including a pair of heat shields for respectively shielding said lamp holder members from heat and radiation generated by the lamp during holder use.

8. A double ended high intensity lamp holder, comprising:

a frame; and a pair of lampholder assemblies mounted on said frame, said lamp holder assemblies respectively including a pair of generally U-shaped lamp holder members for receiving and supporting opposite ends of a double ended bulb, and support means for resiliently supporting said lamp holder members to permit three dimensional displacement thereof relative to said frame, whereby said lamp holder assemblies movably accommodate thermal and mechanical stress during lamp use.

9. The double ended high intensity lamp holder of claim 8 wherein said support means for resiliently supporting said lamp holder members comprises a plurality of springs.

10. The double ended high intensity lamp holder of claim 9 wherein said support means comprises a pair of generally U-shaped support bracket mounted on said frame, and spring means for resiliently suspending said pair of lamp holder members respectively within said pair of support brackets.

11. The double ended high intensity lamp holder of claim 10 wherein said spring means comprises an array of at least three tension springs connected between each of said lamp holder members and the support bracket associated therewith.

12. The double ended high intensity lamp holder of claim 10 further including means for mounting said support brackets on said frame to permit positional adjustment of said support brackets toward and away from each other.

13. The double ended high intensity lamp holder of claim 10 further including a pair of insulators mounted on said frame, said support brackets being respectively mounted on said insulators.

14. The double ended high intensity lamp holder of claim 10 further including terminal means for coupling the lamp to a power supply.

15. The double ended high intensity lamp holder of claim 10 wherein each of said lamp holder members includes a spring clip for snap-fit retention of the lamp end.

16. A double ended high intensity lamp holder, comprising:

a frame adapted for mounting on a housing of a high intensity lamp holder; and a pair of lamp holder assemblies mounted on said frame for respectively receiving and supporting opposite ends of a double ended lamp having a light source disposed between said lamp holder assemblies;

each of said lamp holder assemblies comprising an insulator mounted on said frame, a terminal block mounted on said insulator and including conductive means for connection to a power supply, a generally U-shaped support bracket mounted on said terminal block in a generally upwardly open orientation, a generally U-shaped lamp holder member, a plurality of support springs for mounting said lamp holder member in a resiliently suspended and upwardly open orientation within said support bracket, and a spring clip mounted on said lamp holder member for snap-fit retention of one end of a double ended lamp within said lamp holder member;

said lamp holder assemblies being mounted on said frame with said lamp holder members generally aligned for respectively receiving and resiliently supporting the opposite ends of the double ended lamp.

17. The double ended high intensity lamp holder of claim 16 further including a pair of insulative heat shield plates mounted respectively at inboard sides of said lamp holder assemblies for shielding said lamp holder assemblies from heat and radiation generated by the lamp during fixture use.

18. The double ended high intensity lamp holder of claim 16 wherein said plurality of support springs for each of said lamp holder assemblies comprises an array of at least three tension springs.

* * * * *